United States Patent [19]

Garte

[11] 3,941,423

[45] Mar. 2, 1976

[54] METHOD OF AND APPARATUS FOR EXTRACTING OIL FROM OIL SHALE

[76] Inventor: Gilbert M. Garte, 62 Curtis St., Scituate, Mass. 02066

[22] Filed: Apr. 10, 1974

[21] Appl. No.: 459,641

[52] U.S. Cl. ..... 299/8; 166/259; 175/95; 299/14; 299/57

[51] Int. Cl.[2] ..... E21B 43/24; E21C 41/10

[58] Field of Search ..... 299/2, 8, 56, 57, 14; 166/259; 175/12, 95, 96

[56] References Cited

UNITED STATES PATENTS

| | | | |
|---|---|---|---|
| 902,517 | 10/1908 | Wittich | 299/56 X |
| 2,756,037 | 7/1956 | Kirkpatrick | 299/56 |
| 2,800,316 | 7/1957 | Henderson | 299/2 X |

FOREIGN PATENTS OR APPLICATIONS

| | | | |
|---|---|---|---|
| 14,494 | 6/1912 | United Kingdom | 299/2 |

*Primary Examiner*—Ernest R. Purser
*Attorney, Agent, or Firm*—Beall & Jeffery

[57] ABSTRACT

Method of and apparatus for extracting oil from oil shale. An excavating unit is driven by supplying steam to a plurality of steam engines mounted in an annulus between stationary outer and inner casings. A hollow center column and apertured screw vane are mounted for rotation in the inner casing and helical screw sections are provided outwardly of the inner casing at both ends of the apparatus for directing material to and from the inner casing. Steam is supplied to the unit for driving the center column and helical screws, with the steam supplied to the center column emanating through openings in the screw vane mounted in the inner casing for separating the oil from the oil shale by pyrolysis. The oil is withdrawn in the form of a vapor product by means of a vacuum applied to the inner casing for separation and condensation at the surface. Following excavation, the unit can be withdrawn to the surface under its own power.

14 Claims, 8 Drawing Figures

METHOD OF AND APPARATUS FOR EXTRACTING OIL FROM OIL SHALE

BACKGROUND OF THE INVENTION

The present invention relates as indicated to a method of and apparatus for extracting oil from oil shale.

It has long been known that vast quantities of oil are stored in oil shales occurring primarily in the western part of the United States. It is also common knowledge that the extraction of oil and gas from such oil shale is technically feasible, with the primary impediment in the past to production of oil and gas from shale being the relatively uneconomic costs of extracting the same from the shale. Only relatively recently with the substantial increases in the price of crude oil has the extraction of oil from shale become economically competitive, and major efforts are currently being undertaken in an effort to produce oil from shale as a viable alternative source of oil.

Efforts in the past to extract oil from shale has centered primarily in the mining of the oil shale either through conventional underground mining operations or by strip mining, where the shale seams are relatively near the surface. A continuing problem which has still not been satisfactorily resolved is the satisfactory disposition of the spent shale remaining following the oil extraction process. Since extractable oil in the oil shale constitutes a relatively small percentage in terms of volume of the oil shale, the spent shale following oil extraction must be disposed of, and major environmental considerations must necessarily be dealt with if oil shale is to be processed in the quantities presently envisioned.

Perhaps the most prevalent thinking in terms of spent shale disposition is the provision of specified areas for the spent shale, referred to as tailings, in much the same manner as tailings produced in other underground mining operations. This proposed solution not only requires the handling of vast quantities of material, it also necessitates treatment of the tailings after deposition thereof to meet rather stringent local environmental legislation. Usually, such legislation requires that the areas of deposit be suitably contoured and landscaped, which obviously contributes to the high costs of shale oil production.

More recent suggestions have involved the formation of large underground caverns the pressure and temperature of which are controlled so as to force the shale oil which is in vapor form as a result of such pressure and temperature to the surface while the spent shale remains in the cavity. Although this proposed method does apparently solve the tailings problem, the technical feasibility is still largely undetermined, as are other environmental considerations such as the effect of such operations on underground water supplies, etc.

SUMMARY OF THE INVENTION

With the above in mind, a primary object of the present invention is to provide apparatus in which the oil can be recovered from the shale in situ without involving subsequent treatment and disposition of the spent shale following oil recovery.

It is a further, more specific object of the invention to provide oil extraction apparatus which is relatively portable and which is constructed and arranged to descend through the earth propelled by its own grinding action. The apparatus in normal operation descends to the bottom of the shale seam and can thereafter be reversed for upward movement to the surface with the spend shale remaining in the area as the apparatus ascends.

A further object of the invention is the provision of apparatus in which preferably high pressure steam is employed to drive engines mounted on the apparatus by which the screw action is effected causing the apparatus to descend through the shale bed. Steam, preferably in combination with compressed air, is also supplied to the interior of the apparatus at temperatures of approximately 900° F for reaction with the constituents of the shale to effect pyrolysis of the shale, with the separated oil being thereafter directed from the apparatus for treatment above surface.

In accordance with the invention, the shale during the descent of the apparatus through the shale seam is directed to the interior of the apparatus through a crusher plate which functions to comminute the shale in order to facilitate the extraction process. As steam is admitted to the interior of the apparatus, the oil is extracted from the shale, due to the pressure and temperature conditions resulting from the steam admission, with the vaporized shale oil being withdrawn from the periphery of the apparatus and conveyed to separation equipment mounted on the surface. The remaining, spent shale is forced through an upper grinding plate as the apparatus descends whereby the spent shale remains in situ during the operation of the apparatus. When the apparatus has descended through the shale belt, the drive engines and consequently the screw action is reversed and the apparatus is propelled by its own grinding action upwardly through the spent shale until the apparatus reaches the surface. There is thus no hole or opening formed in the surface as such, and the apparatus can be moved to an adjoining area and the operation repeated. As will be presently described, several units can be assembled together to increase the productivity in a specified area of operation.

Another object of the present invention is to provide an apparatus of the type described in which an alternative form thereof permits the rate of descent or ascent to be controlled by mounting the upper and lower crushing plates for retraction thereby allowing faster penetration of the apparatus through the earth. This feature is of particular importance where the apparatus must penetrate a relatively substantial amount of overburden before reaching the shale oil seam. When the seam is reached, the upper and lower crushing plates can be extended into their crushing positions for crushing the shale directed inwardly of the apparatus.

It will be understood that although the apparatus in accordance with the invention is specifically designed for use in the processing of shale oil as will be presently described, the apparatus can be used for other excavation operations where circumstances warrant. It should also be understood and it will become apparent as the description proceeds that the apparatus is designed primarily for use in areas where the overburden is not excessive and the oil shale can be reached without difficulty. The rate of descent of the apparatus will of course depend to some extent upon the make-up of the overburden and the degree of compaction of the oil shale.

These and other objects will become apparent as the following description proceeds in particular reference to the application drawings.

BRIEF DESCRIPTION OF THE APPLICATION DRAWINGS

DETAILED DESCRIPTION OF THE PREFERRED EMBODIMENTS

Figure 1:
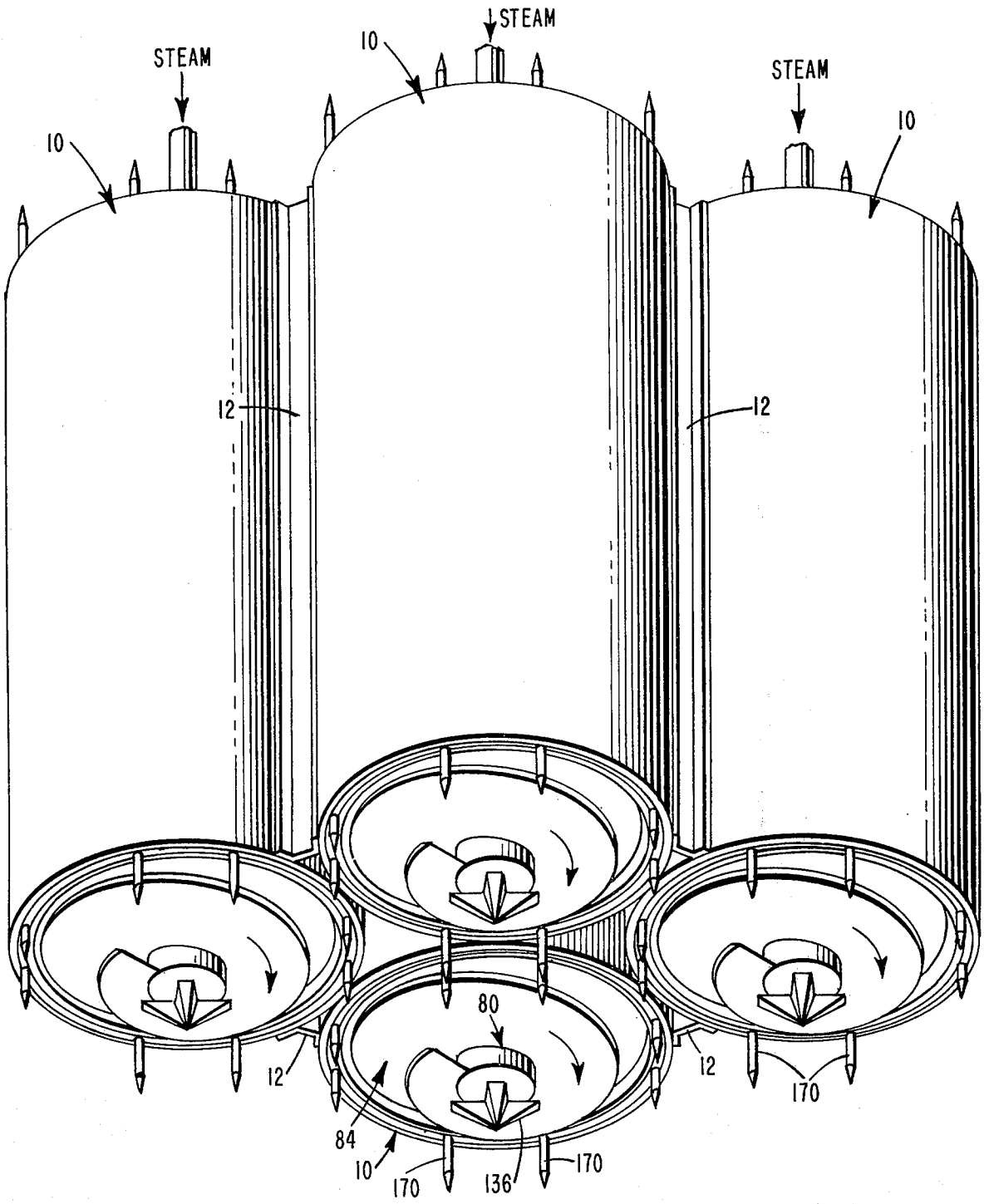
FIG. 1 is a perspective view showing a plurality of individual units constructed in accordance with the invention arranged together for simultaneous operation thereby to increase the production capacity of the system. The bottom of each unit is exposed in FIG. 1 for the purpose of more clearly illustrating that portion of the apparatus.

Referring initially to FIG. 1, there is illustrated therein an assembly of individual units constructed in accordance with the present invention, each of which is generally indicated at 10, which are joined to each other by flanges commonly designated at 12, with the connection being made by any suitable means such as welding or the like. By assembling a plurality of individual units 10, a greater quantity of material can be treated simultaneously. Each individual unit 10 is separately controlled, with the controls being preferably synchronized so that the units descend through the material being penetrated at the same rate. The oil recovered during the descent of the units 10 is conveyed to treatment equipment stored on surface for condensing and separating the oil from the vapor products drawn from the units as will be hereinafter described in detail.

Figure 2:
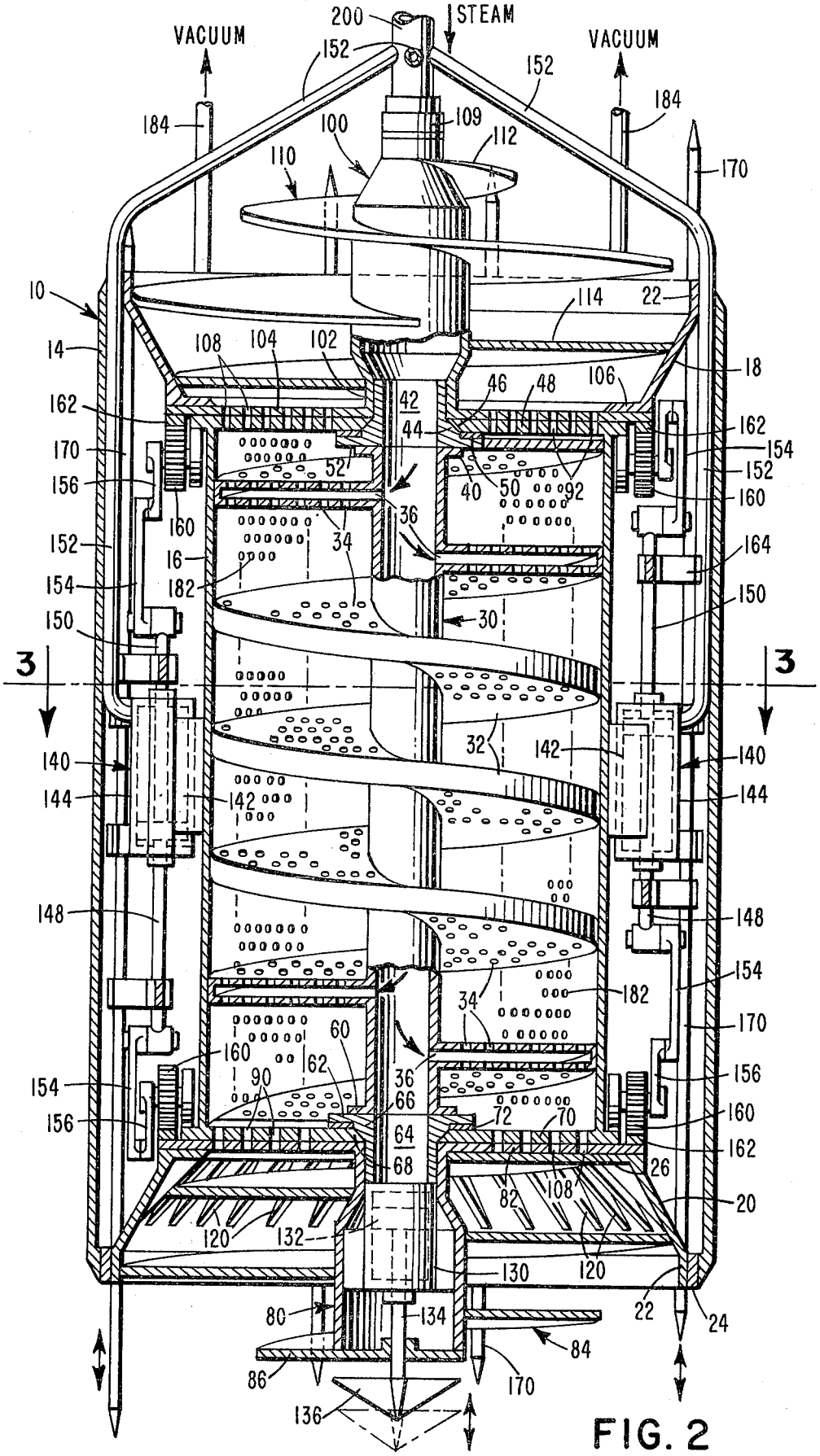
FIG. 2 is a vertical sectional view through one of the units shown in FIG. 1.

Referring to FIG. 2, which comprises a vertical cross-sectional view through an individual unit 10, the unit 10 comprises an outer cylindrical casing 14 and an inner casing 16 mounted in spaced relation within the outer casing. Supporting skirts 18 and 20 are mounted at the upper and lower ends, respectively, of the outer casing and are, as illustrated, relatively dish shaped, with the outer flanges commonly designated at 22 being circular and securely mounted to the outer casing through spacing members 24. The rigid connection of the flanges to the outer casing 14 through the spacer members 24 can be effected by any suitable means such as welding, fastening or the like. The skirt members 20 are formed with a plurality of radial webs 26, only one of which is visible in the bottom portion of FIG. 2, which serve to align and support not only the inner casing 16 but the components which rotate therewithin.

Mounted for rotation within the inner casing 16 is a hollow column generally indicated at 30 to which is rigidly mounted a helical screw the individual vanes of which are commonly designated at 32. As can be seen in cross section in FIG. 2, each vane 30 is hollow and formed in the top and bottom surfaces thereof with a multitude of openings commonly designated at 34. The inner periphery of the helical screw is open for fluid communication with the interior of the column, and the inner periphery of the screw can be rigidly secured to the column for rotation therewith by any suitable means such as welding or the like. The column 30 is formed with vertically and circumferentially spaced openings commonly designated at 36 for directing fluid admitted to the column to the screw vanes. The diameter of the vanes 32 is such as to permit rotation of the column and vanes within the fixed inner casing 16.

The top of the column 30 is formed with a radial flange 40 which is rigidly secured to an upper hub member 42 having a bearing shoulder 44 that is contiguous a conical bearing surface 46 formed on the top plate 48 of the inner casing 16. A bearing seal 50 is interposed between the lower flange 52 of the hub 42 and the section of the plate immediately above such flange.

The bottom of column 30 is mounted in the same manner, being formed with a bottom flange 60 rigidly mounted to flange 62 of hub 64, with the latter being formed with a bearing shoulder 66 for rotatable engagement with bearing surface 68 formed on the inner periphery of bottom plate 70 of the inner casing 16. A seal 72 is positioned between the flange 62 and the plate 70.

A steam hammer casing member generally indicated at 80 is telescoped around the bottom section of hub 64 and secured thereto for rotation therewith by keying or the like. The casing 80 includes a circular top plate 82 which extends radially between the bottom plate 70 of the inner casing 16 and the webs 26 of the skirt member 20. The spacing of these members is such as to permit rotation of the top plate 82 relative to the fixed inner casing 16 and skirt member 20.

The casing 80 is diametrically enlarged at its bottom end and rigidly secured thereto is a helical screw generally indicated at 84 the sections of which gradually increase in diameter from the lower section 86 thereof to the upper sections thereof which are contained within the skirt 20. The helical screw 84 is of course continuous and, unlike the vanes 32 above described, the screw sections are solid. The drive connection between the center column 30 and the steam hammer casing 80, through hub 64, results in the simultaneous rotation of all the screw members described and illustrated whereby the material can be fed upwardly into the interior of the inner casing and vertically therethrough in a manner to be hereinafter described.

Both the bottom and top plates 70 and 48, respectively, of the inner casing 16 are formed with openings 90 and 92, whereby the plates function as crushing plates for the material fed upwardly through the unit. The openings 92 formed in the upper plate 48 are smaller than the openings 90 formed in the bottom plate 70 whereby the upper plate functions to finely crush the material before the same is discharged from the apparatus.

The upper portion of the unit, in the orientation of FIG. 2, is constructed similarly to the bottom. Thus, a steam hammer casing generally indicated at 100 is mounted on the top of the center column 30 for rotation therewith. The casing 100 includes a hub portion 102 that is telescoped around the hub 42 and secured for rotation therewith by keying means or the like.

Extending radially from the hub portion 142 is a circular plate 104 which overlies the top plate 48 of the inner casing 16, and which at its outer periphery extends below the webs 106 of the skirt member 18. The spacing of these members is such as to permit rotation of the plate 104 relative to the stationary inner casing 16 and skirt 18. Plate 104 and the bottom plate 82 which is integrally formed with the steam hammer casing 80 are both formed with openings commonly designated at 108 for passing material therethrough during the digging operation. A rotatable coupling 109 is positioned between the casing 100 and the fixed steam conduit 200 which supplies steam to the unit.

Integrally secured to the steam hammer casing 100 is a helical screw generally indicated at 110 the diameter of which gradually increases from the extreme upper end 112 thereof to the lower end 114 thereof which is positioned within the skirt 18.

It will thus be seen that the helical screws 84 and 110 which are secured to the steam hammer casing 80 and 100, respectively, rotate simultaneously with the center column 30 whereby material is fed into the apparatus through the bottom thereof and upwardly through the inner casing 60 for discharge from the top of the unit by the helical screw 110. During the descent of the unit through the material to be handled, the helical screw 84 and picks up and conveys the material upwardly toward the skirt 20, and to facilitate the coarse crushing of the material before the same reaches the inner casing 16, the skirt 20 is provided with a series of ribs commonly designated at 120, adjacent pairs of which define grinding pockets through which the material must pass and necessarily be comminuted before passage upwardly through openings 108 formed in the bottom plate 82 of the steam hammer casing, and thereafter through openings 90 formed in the coarse crushing plate 70. The rotation of the helical screw 84 within the fixed skirt 20 facilitates the preliminary grinding or crushing affected by the ribs 120, with the material being directed radially outwardly due to the rotation of the helical screw 84.

Mounted within the steam hammer casing 80 is a steam cylinder 130 the top of which is rigidly secured to the casing 80 directly beneath the bottom face of the column 30. Mounted for reciprocation within the cylinder 130 is piston 132 having a shaft 134 carrying at its outer end a steam hammer 136. Simultaneously with the rotation of the column 30 and the components operatively connected thereto by steam power, steam is applied through the interior of the column 30 to the interior of the cylinder 130 either directly through openings formed therein or by a separate line leading into the piston chamber. The piston 132 and the steam hammer 136 carried thereby are consequently forced downwardly by the steam pressure into contact with the material, with the steam hammer 136 being generally conical shaped to provide a pointed leading end to facilitate breakup of the material. Due to the constant application of steam pressure and the resistance encountered in descending through the material, the steam hammer 136 due to the steam pressure and material impact essentially continually reciprocates thereby enhancing the breaking up of the material. If desired, steam could be supplied to and exhausted from the cylinder 130 in timed sequence so as to provide positive reciprocating movement of the steam hammer.

Figure 3:
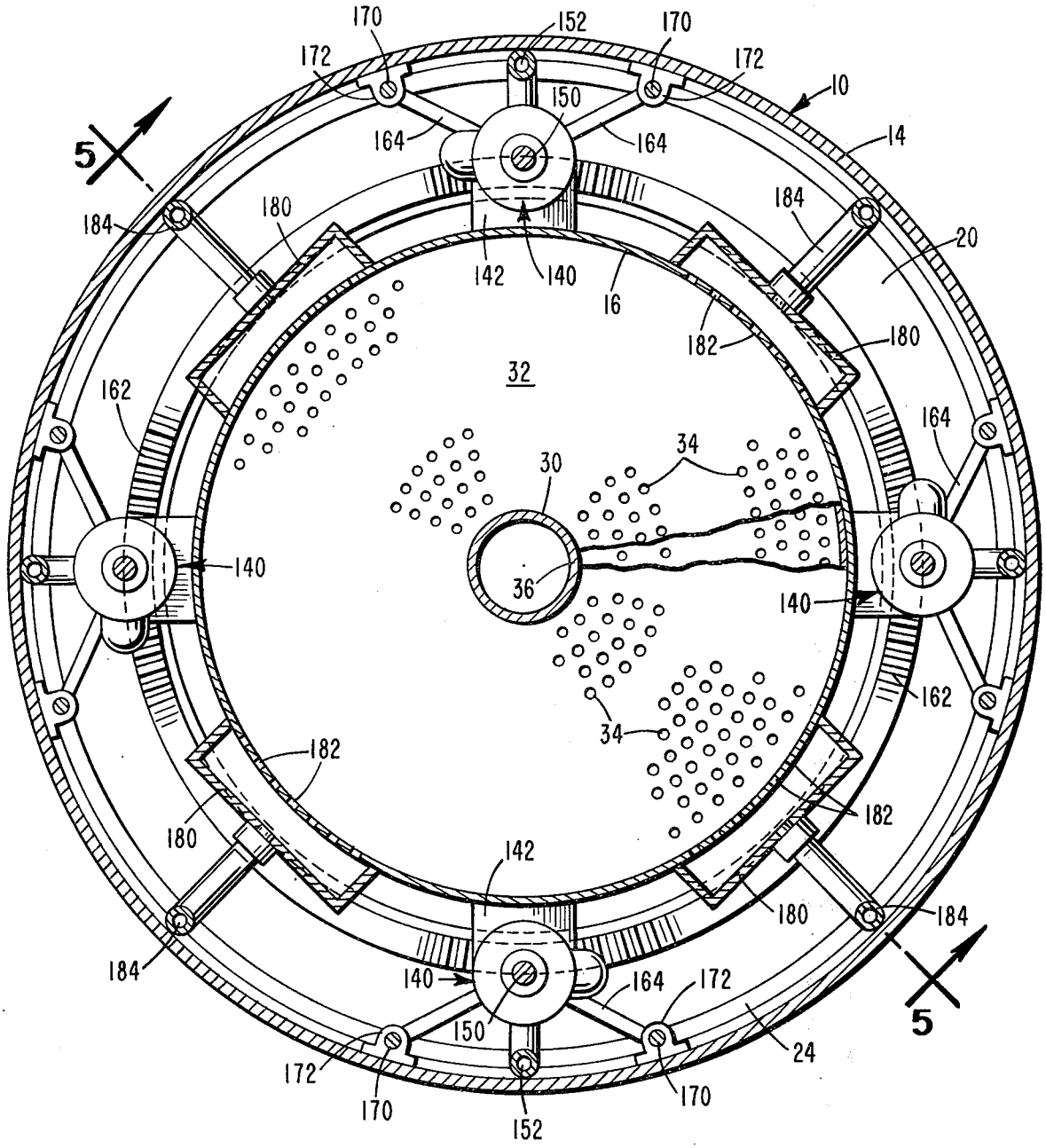
FIG. 3 is a sectional view taken on line 3—3 of FIG. 2.
Figure 4:
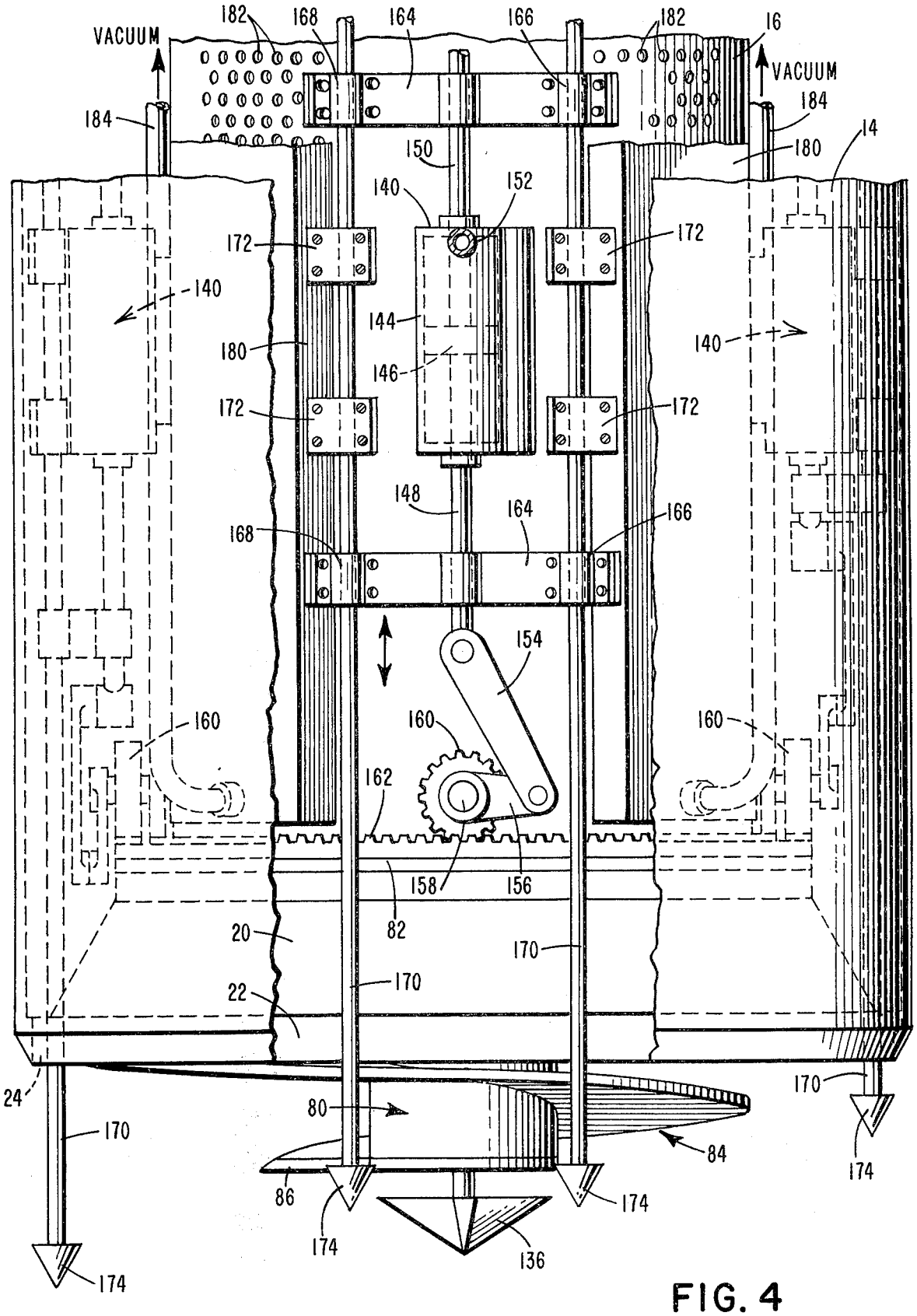
FIG. 4 is a side elevational view, partially fragmented, more clearly illustrating the manner in which the bottom crushing plate is rotated.

Referring to FIGS. 2–4, plurality of steam engines commonly designated at 140 are mounted on the inner casing 16 in the space between the same and the outer casing 14, with the engines comprising four in number in the form shown, spaced approximately 90° around the inner casing as shown in FIG. 3. The engines 140 are mounted to the inner casing 16 by brackets commonly designated at 142.

As perhaps best shown in FIG. 4, each steam engine 140 comprises a cylinder 144 having a piston 146 mounted therein connected at its opposite ends to piston rods 148 and 150. Pressurized fluid in the form of steam or compressed air is supplied to the cylinder 140 through fluid lines 152 which extend through the cylinder upwardly between the casings to a source off pressurized fluid exteriorly of the unit.

The shaft 148 is pivotally connected to a crank arm 154 which in turn pivoted to a connecting arm 156 which carries a shaft 158 to which is secured by keying or the like a pinion 160 the teeth of which engage a rack 162 which is secured to the top plate 82 of the steam hammer casing 80 for rotating the same, and thus the center column 30 drivingly connected thereto.

Referring to FIG. 2, the piston rod 150 is similarly connected through crank and connecting arms to a pinion for driving a rack rigidly attached to plate 104 of the steam hammer casing 100, with the drive components for rotating the upper rack being identified by the same reference numerals as the lower drive elements. It will thus be seen that reciprocating movement of the piston rods 148 and 150 when actuated by fluid pressure delivered to the cylinder 144 will effect rotation of the pinions 160 for driving the racks operatively connected thereto, thereby driving the top plates of the steam hammer casings an the center column 30.

A bracket 164 is securely mounted to the piston rod 148 for reciprocation therewith, and the lateral ends 166 and 168 of the bracket are formed with circular openings for receiving impacting tools commonly designated at 170, which can be pinned or otherwise secured to the bracket ends. Guide brackets commonly designated at 172 are secured to the inner surface of the outer casing 14 for guiding the impact tools 170 during reciprocating movement thereof.

As clearly shown in FIG. 3, the impact tools 170 can be generally circular in cross section and are spaced circumferentially around the unit. As can be seen in FIG. 4, the impact tools carry impacting heads at the upper ends thereof as well as the bottom to facilitate ascent of the unit following excavation. The tips 174 of the tools can be formed of any suitable material, such as hardened steel or alloyed steel, or equivalent materials, so as to withstand repeated use of the impact tools before replacement thereof.

Figure 5:
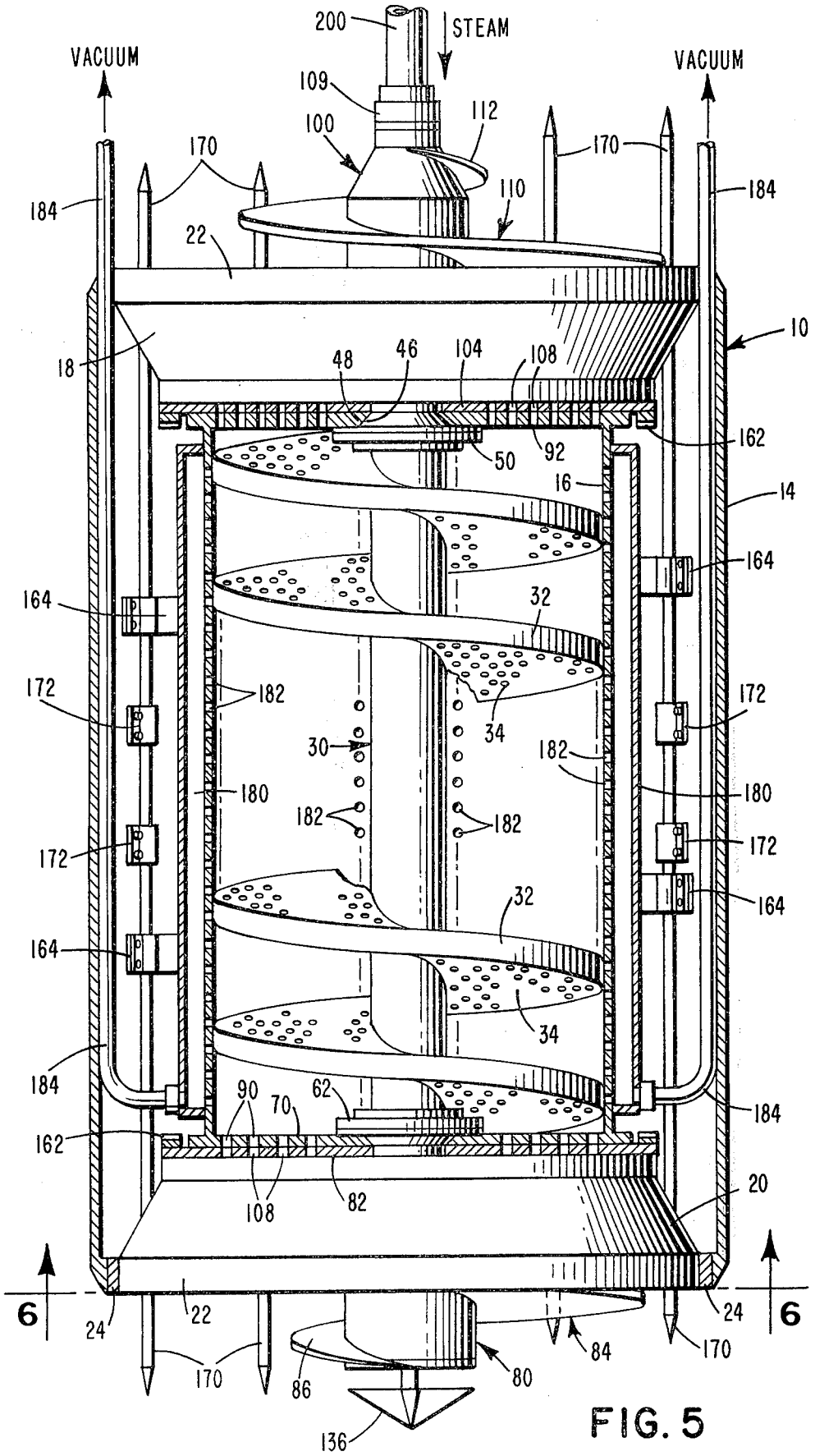
FIG. 5 is a sectional view taken on line 5—5 of FIG. 3.
Figure 6:
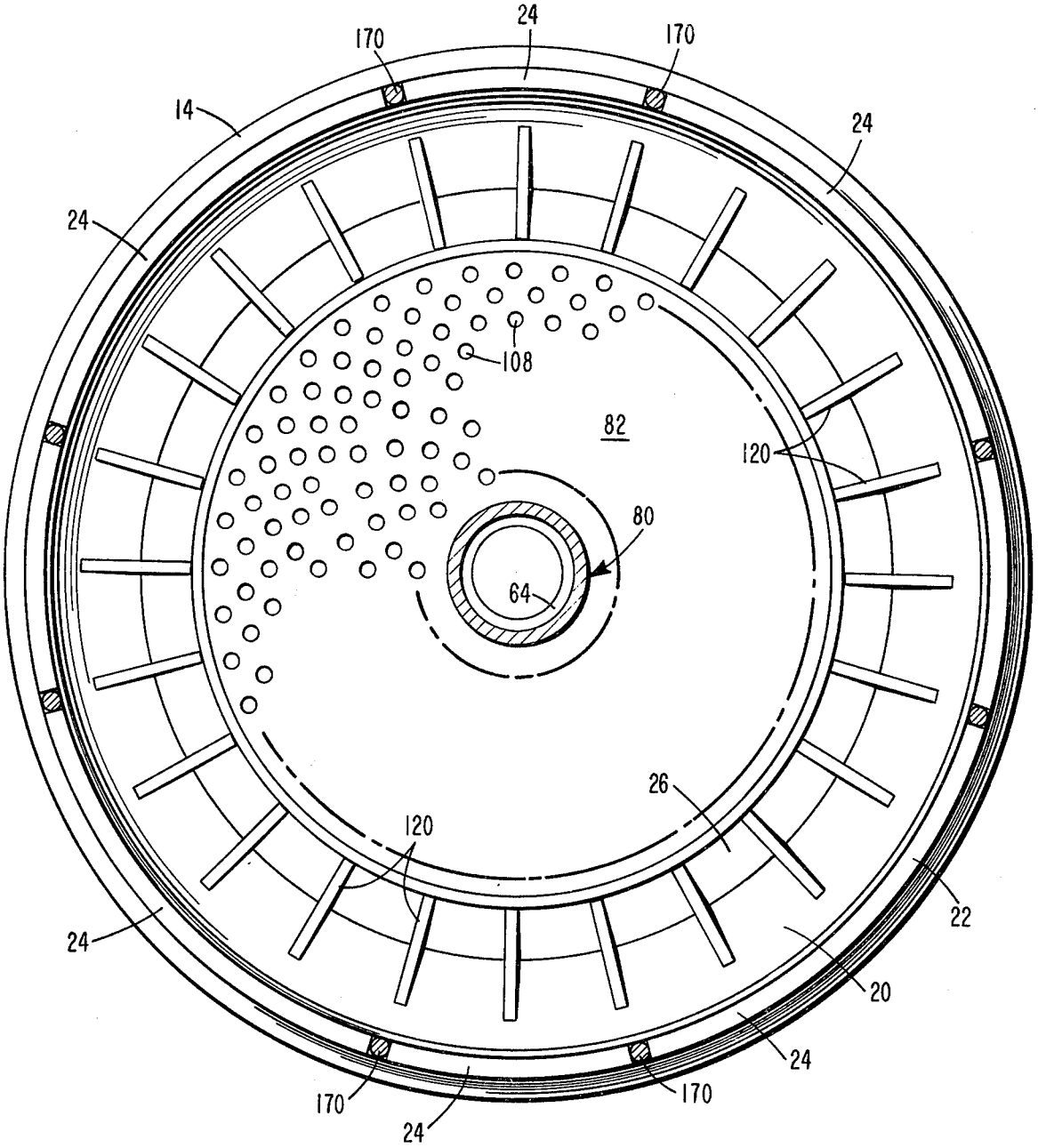
FIG. 6 is a sectional view taken on line 6—6 of FIG. 5.
Figures 7, 8:
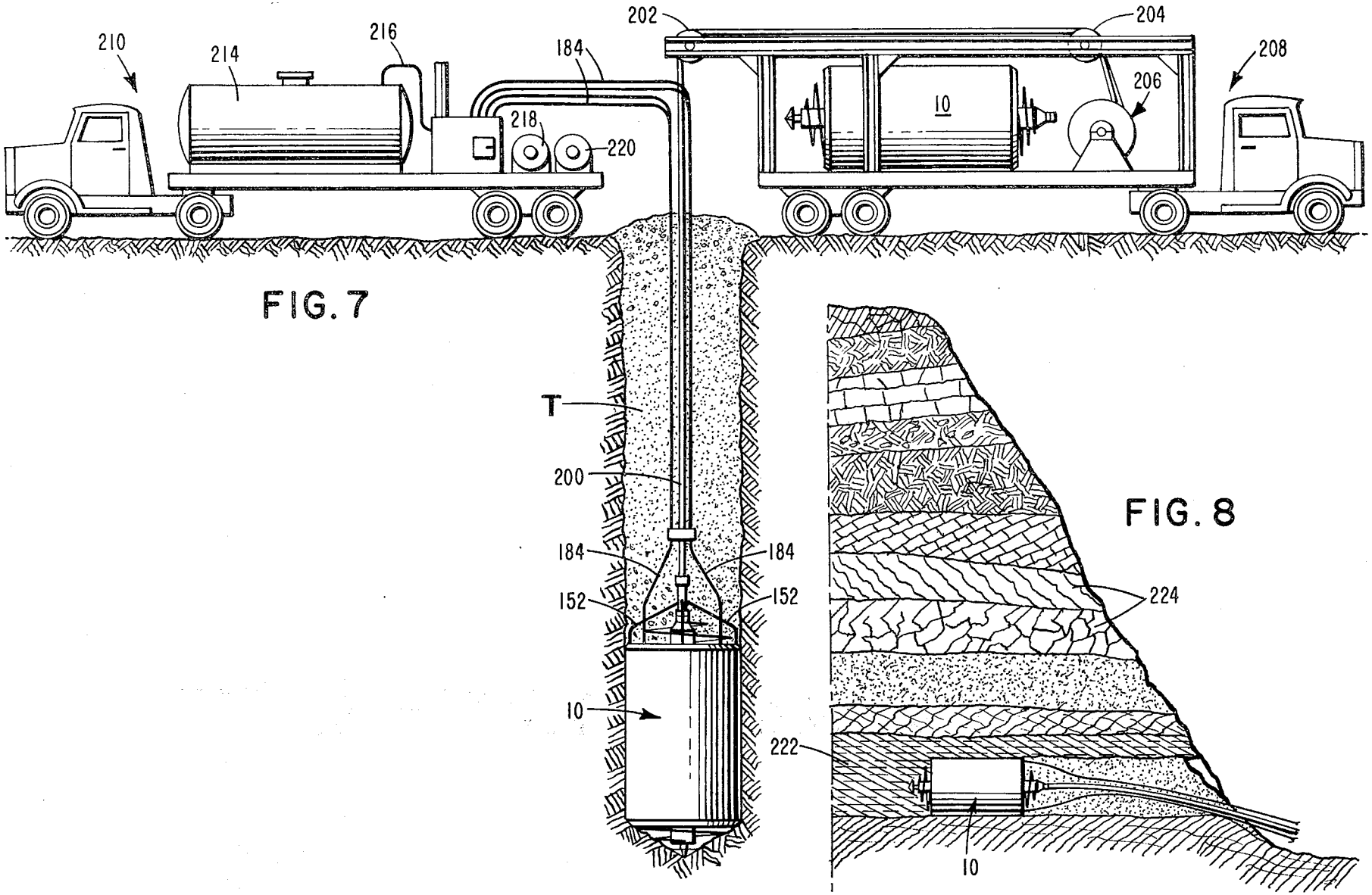
FIG. 7 is a side elevational view of the unit in actual operation, with supporting equipment.
FIG. 8 is a side elevational view showing the unit excavating laterally.

Referring to FIG. 3, a plurality of vacuum chambers commonly designated at 180 are mounted in circumferentially spaced relation around and to the inner casing 16, with the chambers in the form shown being approximately 90° apart. As shown in FIG. 5, the chambers extend substantially the full height of the inner casing, and the latter in the region of such chambers is formed with openings therethrough which are commonly designated at 182. The vapors produced during the operation of the device are discharged from the inner casing through such openings 182 into the vacuum chambers 180, and each such chamber is connected to a vacuum line 184 which directs the vapor products to separation equipment on the surface for condensing and separating the vapor products. As seen in FIG. 3, the vacuum chambers 80 are interposed between the steam engines 140 in the annulus between the inner and outer casings. Referring to FIG. 7, there is illustrated therein a typical operating environment for the invention. The unit 10 is shown at an excavation level substantially below ground level, with the finely crushed tailings indicated at T being discharged from the unit above the same as the unit descends through the formations. Steam is supplied to the unit through main steam pipe 200 which supplies steam to the column 30 and through steam lines 152 which as described above are in full communication with the cylinders of the steam engines. The center steam pipe 200 and steam lines 152 are winched over winch drums 202 and 204 for connection to a steam compressor generally indicated at 206 mounted on the truck 208 located at the site. As shown, the truck 208 also carries a further unit 10 in the event tandem operation is desired.

A retort vehicle generally indicated at 210 is also located on site and carries additional equipment needed for oil recovery. For example, the vacuum lines 184 leading from the vacuum chambers 180 communicate with a unit 212 equipped with vacuum producing means and a separator for separating the vapor products into recoverable oil and non-recoverable waste products. The recoverable oil is delivered from the unit 212 to a storage tank 214 through flow line 216. It will be understood that a pump could be provided in such line of necessary. The non-recoverable fluids can be vented or otherwise collected for further treatment.

Compressed air units 218 and 220 are also mounted on truck 10 and are employed if the supply of compressed air with the steam is necessary or desirable for more efficient operation of the unit.

It will be understood that the various supporting equipment shown in FIG. 7 is schematically represented, and that such equipment per se does not form part of the present invention. However, the support function provided by such equipment permits efficient operation of the unit, and it will be understood that conventional equipment may be employed as needed to enhance the capabilities of the unit.

There is illustrated in FIG. 8 an alternative mode of operation of the unit 10, with the unit in this figure being positioned on its side and shown excavating through an oil shale seam 222, with the overburden formations being commonly designated at 224. This mode of operation is particularly adapted to conditions wherein the shale seal outcrops at the surface as illustrated, thereby rendering the operation more efficient since excavation through overburden formations is not necessary.

The operation of the unit should be apparent from the above description. To briefly summarize, the unit 10 descends through the formation under steam pressure supplied to the center column 30 and the steam engines 140. The steam engines drive upper and lower racks 162 through pinion and crank arm arrangements thereby rotating the steam hammer casings 80 and 110, and the center column 30. The helical screws 84 and 110 which form part of the steam hammer casings, and the vanes 32 operatively connected to the center column are thereby rotated forcing the material below the unit upwardly through the crushing plate provided at the bottom of the casing and into the interior of the inner casing 16. The material entering the inner casing is subjected to steam which enters the center column 30 and is directed to and through openings 34 formed in the vanes 32. The steam functions to vaporize the oil contained in the shale and thereby extract the same from the shale, with the vapor products being drawn from the casing through openings 182 to vacuum chambers 180, which communicate with vacuum lines 184 which are directed to surface separator equipment. In the excavation, preliminary grinding is provided by ribs 120 formed on the skirt 20, with the material being forced between the ribs for comminution thereby before passage through the openings in the bottom crushing plate.

The material passing upwardly through the inner casing is discharged through the openings in the top crusher plate and is conveyed by the helical screw 110 away from the unit. The treatment of the material within the inner casing and the accompanying communition serves to expand the material and increase the porosity thereof thereby enhancing ascent of the unit after the excavation process. When the oil shale seam has been passed through by the unit, the rotation of the helical screws are reversed by any suitable mechanical, hydraulic or electrical means or combinations of these, well known to those skilled in the art. The unit consequently ascends through the opening previously formed during descent. The expansion of the material during pyrolysis facilitates the ascent of the unit through such material back to the surface for further operation.

The impact tools operated by the steam engines break up the material at the periphery of the unit thereby facilitating movement of such material toward the ribs formed on the bottom skirt for preliminary grinding prior to passage through the bottom crushing plate to the inner casing. Similar impact tools are provided for facilitating ascent of the unit following excavation.

It will be apparent that modifications can be made in the above described preferred embodiment without, however, departing from the spirit of the invention. For example, steam, compressed air and gas could be supplied to the area beneath the unit to effect burning of the material prior to passage through the unit. The combustion of such products would in effect disintegrate the material below the unit thereby substantially reducing the quantity of material passing through the unit. Such disintegration would not be accompanied by substantial loss of vapor products inasmuch as the vapor products would necessarily ascend through the unit for withdrawal through the vacuum chambers. The necessary steam, compressed air, and gas lines could be directed to the area beneath the unit by fluid lines passing through the spacers 24 which space the skirt 20 from the outer casing 14, with nipples directing the fluid through the axis of the unit to enhance the combustion process.

A further modification which would increase production of the unit would be to provide both the upper and lower crushing plates in retractable sections whereby the same could selectively be retracted for optimum efficiency. For example, while digging through overburden, the crushing plates could be extracted whereby the material excavated could be directed upwardly straight through the unit without undergoing the course and fine crushing operation. Once the shale seam is reached, the lower crushing plate could be extended whereby the material would pass through the crushing openings in the crushing plate for comminution prior to entering the inner casing. Such comminution is of course important in extracting the oil from the shale within the unit. During descent, the upper crushing plate could be retracted to facilitate discharge of the material from the unit. Upon ascent, both crushing plates could be retracted to facilitate movement of the unit upwardly to the surface, with grinding by the upper and lower crushing plates being eliminated in such instances. Preliminary grinding may be effected by a skirt having a plurality of integrally formed and spaced bosses or teeth rather than separately formed ribs, with the grinding in such alternative arrangement being effected by the pockets defined by adjacent teeth.

Although steam has been disclosed and is the preferred form of power for the engines driving the helical screws, it will be understood that other forms of power could also be employed, such as hydraulic, mechanical, or electrical, or any combination of such forms, possibly in combination with steam, as desired. For example, where water is available only in limited quantities at the site, a diesel electric generator could be employed to power electric motors for driving the helical screws. Where availability of water is a severe problem at the site, pyrolysis of the oil shale could be effected solely by disintegration, as described, below the unit, with the vapor products ascending through the inner casing and drawn therefrom under vacuum.

As above noted, the unit is specifically designed to operate in any desired excavating environment. In addition to treatment of oil shale as described, the unit is ideally suited to the excavation of other oil-bearing formations such as tar sands, the importance of which as a further source of oil is becoming increasingly recognized. Relatively high production rates can be achieved by use of the unit in tar sands due to the softer sand formation, in comparison with the relatively tightly compacted oil shale.

I claim:

1. Material processing apparatus comprising:

a. an outer fixed casing;

b. an inner fixed casing spaced from said outer casing and defining therewith an annulus; said inner, fixed casing being formed with openings through which vaporous products within said inner casing can pass, c. helical screw means mounted for rotation within said inner casing and extending above and below said outer casing for conveying material toward and away from said unit;

d. drive motor means mounted in said annulus, e. means operatively connecting said drive motor means and said helical screw means for rotating the latter whereby material can be directed to and through said unit, and f. means fur supplying steam to said inner casing for contact with said material directed to and through said unit.

2. The excavating apparatus of claim 1 wherein said helical screw means comprises a hollow center column positioned centrally within said inner casing, a hollow helical screw vane attached to and rotating with said center column, and helical screw sections disposed at both ends of said inner casing, with said helical sections decreasing in diameter outwardly of said unit.

3. The excavating apparatus of claim 2 wherein said center column is formed with openings for communicating the interior thereof with said hollow helical vane for supplying fluid thereto, said helical vane also being formed with a plurality of openings on the top and bottom thereof for discharging fluid supplied thereto from said center column, and means for supplying steam to said center column and thus said helical vane for discharge into the interior of said inner casing for directly contacting the material fed thereto.

4. The excavating apparatus of claim 3 further including a steam hammer casing positioned at the opposite ends of said center column and rigidly secured thereto, said steam hammer casings carrying said helical screw sections positioned exteriorly of said inner casing, the steam hammer casing positioned at the bottom of said unit having mounted therein a cylinder within which is reciprocatingly mounted a piston carrying a piston rod, and an impact hammer carried by said piston rod for engaging and loosening the material in advance of said unit, and means for directing steam to said cylinder.

5. The excavating apparatus of claim 1 further including skirt means positioned above and below, respectively, said inner casing and interconnecting the same with said outer casing, each of said skirts being spaced from said outer casing at its outer most ends by spacer means, and a plurality of ribs formed on the lower most skirt defining between pairs of such ribs comminuting pockets for preliminary grinding said material before entry to said inner casing.

6. The excavating apparatus of claim 5 wherein said inner casing includes top and bottom plates formed with openings therein, and upper and lower crushing plates positioned adjacent said top and bottom plates of said casing and rotating relative thereto, said crushing plates being formed with crushing openings aligned with said openings in said top and bottom casing plates, the material being forced through said crushing openings for comminution therein responsive to the rotation of said helical screw means and the resultant conveying of material upwardly through said bottom crushing plate into said inner casing.

7. The excavating apparatus of claim 1 wherein said drive motor means comprises a plurality of steam driven engines mounted in said annulus, each of the steam engines including a cylinder and piston carrying piston rods at the opposite ends thereof, said piston rods being operatively connected to pinions engaging rack means disposed at the opposite ends of said inner casing and rigidly attached to said steam hammer casings, and means for supplying steam to said steam driven engines for driving said racks and thus said steam hammer casings, a hollow center column mounted for rotation with said steam hammer casings, and means for supplying steam to said engines for rotating said racks and thus said helical screw means and said center column.

8. The excavating apparatus of claim 7 further including impact tools operatively connected to said piston rods for reciprocation therewith, said impact tools extending exteriorly of said outer casing at the opposite ends thereof for engaging the material being excavated at the periphery of said apparatus thereby facilitating the breakup of such material for conveyance to said apparatus by said helical screw means.

9. The excavating apparatus of claim 7 further including a plurality of vacuum chambers disposed in the annulus between said inner and outer casings and positioned between said steam-driven engines, said inner casing being formed with openings in the regions thereof adjacent to said vacuum chambers for directing vapor products from said inner casing to said vacuum chambers, and vacuum lines interconnecting said vacuum chambers with vacuum-producing equipment provided at ground level at the site of excavation.

10. The excavating apparatus of claim 1 further including means for supplying steam, combustible gas and compressed air to an area below said apparatus to provide a combustible mixture for disintegrating the material below said apparatus, the vapor products produced by such combustion being drawn upwardly into said inner casing and being drawn from such inner casing to vacuum chambers mounted in said annulus, and vacuum means communicating said vacuum chambers with vacuum-producing equipment mounted at ground level at the excavation site.

11. The excavating apparatus of claim 1 further including retractable crusher plates carried by said inner casing for crushing material directed to said inner casing by said helical screw means, and means for retracting said crushing plates so as to facilitate the upward movement of material to and through said inner casing thereby expediting the excavating process.

12. A method of extracting oil from an oil-bearing formation comprising the steps of:

a. excavating by means of a self-digging excavating apparatus until said formation has been reached;

b. directing the material in the formation inwardly of said apparatus;

c. directing steam under pressure to the interior of said apparatus for extracting oil in the form of a vapor product from said material;

d. applying a vacuum to the interior of said apparatus for withdrawing said vapor product to the surface for condensation, and e. withdrawing said apparatus under its own power from the excavating opening thereby leaving the tailings in said excavation opening.

13. The method of claim 12 wherein said oil-bearing formation is shale, and further including the step of disintegrating the shale below said unit as it descends by directing and mixing a combustible gas and compressed air to the area below said unit, the combustion of said gas and air effecting separation of the oil from the shale by pyrolysis, with the oil in vapor form ascending through the interior of the apparatus for vacuum withdrawal.

14. The method of claim 12 wherein said oil-bearing formation is tar sand.

* * * * *